United States Patent [19]

Robb et al.

[11] Patent Number: 4,960,142

[45] Date of Patent: Oct. 2, 1990

[54] PAINT CLEANING APPARATUS

[75] Inventors: Richard A. Robb, West Bloomfield, Mich.; Michael J. Grubb, London, Canada

[73] Assignee: Herrules Equipment Corporation, Walled Lake, Mich.

[21] Appl. No.: 358,529

[22] Filed: May 26, 1989

Related U.S. Application Data

[63] Continuation of Ser. No. 135,911, Dec. 21, 1987, abandoned.

[51] Int. Cl.[5] ..... B08B 3/02

[52] U.S. Cl. ..... 134/138; 134/149; 134/157; 134/166 R; 134/200; 269/254 CS

[58] Field of Search ..... 269/254 CS

[56] References Cited

U.S. PATENT DOCUMENTS

| | | | |
|---|---|---|---|
| Re. 7,284 | 8/1876 | Scrannage | 134/138 |
| 75,443 | 3/1868 | Milbunn | 134/138 X |
| 174,090 | 2/1876 | Puffer, Jr. | 134/138 X |
| 289,737 | 12/1883 | Whittle | 134/138 X |
| 1,051,669 | 1/1913 | Boesser | 134/138 |
| 2,078,699 | 4/1937 | Taylor et al. | 134/149 X |
| 2,614,316 | 10/1952 | Daily et al. | 134/138 X |
| 2,764,171 | 9/1956 | Nolte | 134/152 X |
| 2,774,362 | 12/1956 | Nordling | 134/138 X |
| 2,786,000 | 3/1957 | Roach | 134/170 |
| 3,076,468 | 2/1963 | Belt | 134/102 |
| 3,336,463 | 8/1967 | Johnson | 291/366 |
| 3,369,555 | 2/1968 | Heflin, Jr. | 134/149 X |
| 3,433,430 | 3/1969 | Strout | 239/476 |
| 3,542,070 | 11/1970 | Sheeter | 137/625.19 |
| 3,589,926 | 11/1970 | Nesbitt | 134/149 X |
| 3,650,283 | 3/1972 | Lang | 134/170 X |
| 3,707,404 | 12/1972 | Carlson et al. | 134/109 |
| 3,711,539 | 11/1973 | DeSantis | 134/11 |
| 3,890,988 | 6/1975 | Lee | 134/111 |
| 3,904,431 | 9/1975 | Dinerman | 143/88 |
| 4,025,363 | 5/1977 | De Santis | 134/102 |
| 4,133,340 | 1/1979 | Ballard | 134/170 |
| 4,299,245 | 11/1981 | Clapper | 134/152 X |
| 4,788,994 | 12/1988 | Shinbara | 134/153 X |

FOREIGN PATENT DOCUMENTS

| | | | |
|---|---|---|---|
| 363659 | 10/1938 | Italy | 134/153 |
| 2154434 | 9/1985 | United Kingdom | 134/153 |

*Primary Examiner*—Frankie L. Stinson

[57] ABSTRACT

A system for cleaning paint from objects such as spray gun cups, paint cans and lids comprising: an enclosed housing divided into a work chamber and a fluid storage reservoir containing paint solvent; a manifold for distributing solvent, spray nozzles attached to the manifold and adapted to receive and spray pressurized solvent therefrom; a rotable bracket having ribs or legs for supporting a hollow object such as a paint can and a conduit in communication with the manifold which supports spray nozzles which direct a spray pattern upon the hollow object to cause it to turn, another rotary bracket is provided to support a flat object such as a lid of a paint can an includes another conduit with a nozzle for cleaning a surface of the flat object and for causing same to turn in relation to the spray pattern.

10 Claims, 2 Drawing Sheets

FIG. 3
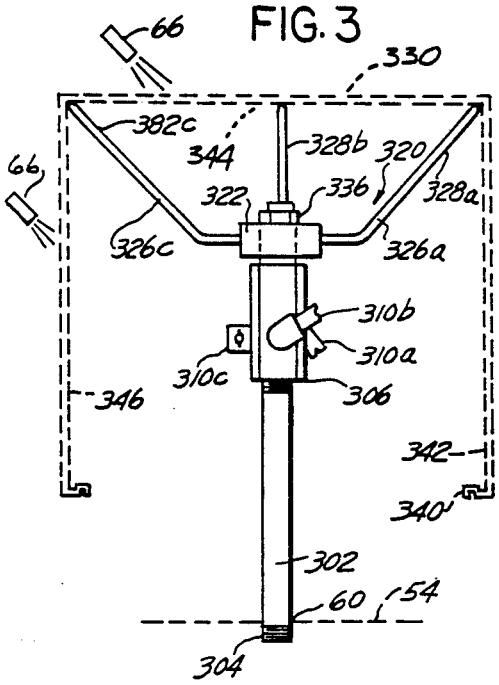
FIG. 4
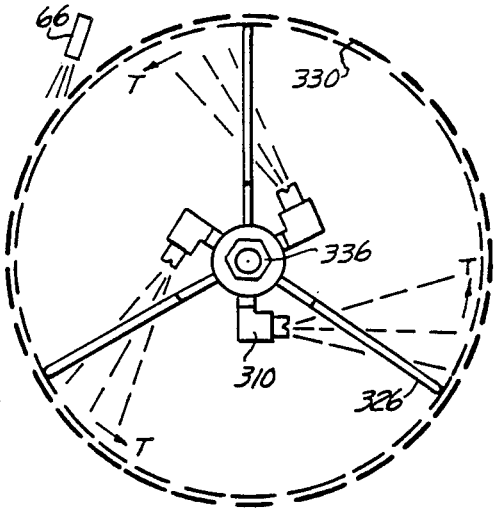
FIG. 5
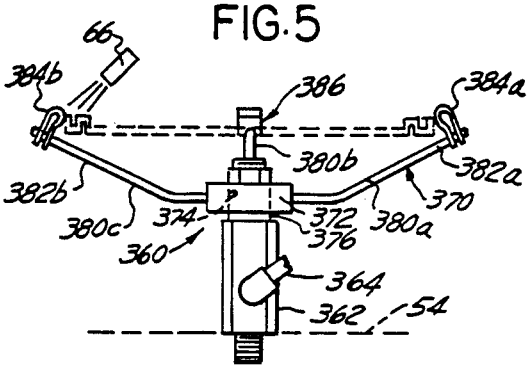
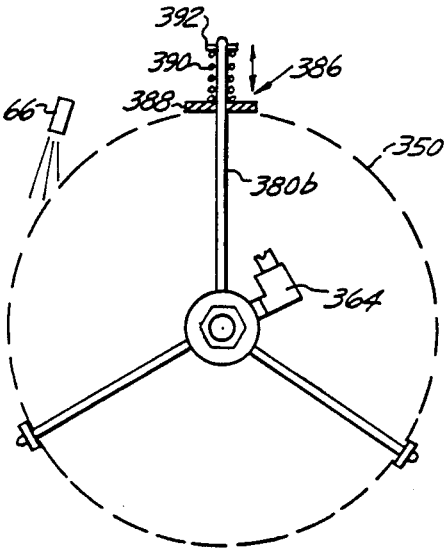
FIG. 6
FIG. 7
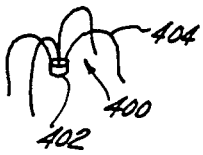

PAINT CLEANING APPARATUS

This application is a continuation of application Ser. No. 135,911, filed Dec. 21, 1987, now abandoned.

BACKGROUND AND SUMMARY OF THE INVENTION

The present invention relates to a system for automatically cleaning paint laden objects and more particularly to a system for cleaning paint cups, normally used with spray guns, paint cans and associated lids including mixing lids.

After using a spray gun a residue of paint is left in the cup and within the various passages of the gun. This residual paint must be removed before the gun and the cup can be used again. Further, with regard to a paint cans and lids it is also desirable to be able to clean same so that they can also be reused.

Typically, the operator, upon completing painting, would disconnected the cup from the gun and discard the excess paint from the cup. Thereafter, the operator would scrub and rinse the cup with paint solvent by hand. This procedure would be repeated until the cup was at least superficially cleaned. Paint or mixing cans would be cleaned in a similar manner or simply disposed. Alternatively, the operator may have immersed the cup, paint can and/or gun in a container of solvent for a period of time to remove the accumulated paint. As can be seen these procedures are both costly, hazardous to one's health, waste generating and time consuming. U.S. Ser. No. 904,097 illustrates one means for automatically cleaning spray guns, cups and cans.

It is an object of the present invention to provide a means for automatically and thoroughly cleaning paint laden objects internally and externally, as the case may be, in a reliable, fast and inexpensive manner.

Accordingly, the invention comprises: a paint removal system for cleaning paint from a hollow object such as a paint can or gun cup comprising: a work chamber and a fluid storage reservoir containing a cleaning agent such as paint solvent or cleaning fluid; a manifold including at least one outlet adapted to receive pressurized solvent; means for recirculating solvent from said reservoir to said manifold; means for supporting the hollow object in an inverted position including: conduit means extending upwardly and in fluid communication with the manifold; a plurality of spray nozzles oriented at angles relative to an axis of the conduit means and in fluid communications therewith; bracket means, rotatable relative to the conduit means including a central member and a plurality of outwardly extending ribs over which the inverted hollow object may be placed. Another embodiment of the invention is related to a mechanism for cleaning a object such a the lid of a paint can and includes: bracket means, for securing the object, rotatable relative to a conduit means including a central member and a plurality of outwardly extending ribs; means are fitted to the ribs for engaging the peripheral edge of the flat object.

Many other objects and purposes of the invention will be clear from the following detailed description of the drawings.

BRIEF DESCRIPTION OF THE DRAWINGS

In the drawings:

FIGS. 3 and 4 illustrate a mechanism for cleaning of hollow objects such as cups and cans.

FIGS. 5 and 6 illustrate a mechanism for cleaning a lid for a paint can.

FIG. 7 illustrates an alternate embodiment of the invention.

DETAILED DESCRIPTION OF THE DRAWINGS

Figure 1:
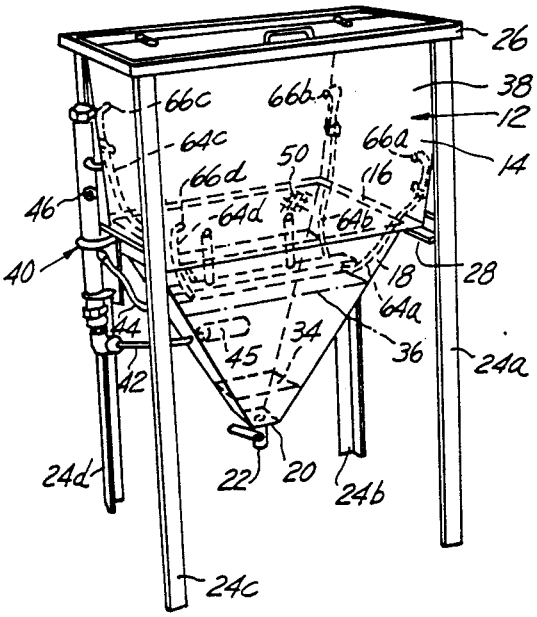
FIGS. 1 and 2 illustrates a system for washing or cleaning paint laden objects.

Reference is now made to FIG. 1 which illustrates an orthogonal view of the present invention. More specifically there is shown a cleaning system 10 comprising a housing, generally designated as 12. The housing 12 includes a generally rectangular upper member 14. The member 14 terminates at a circumferential shoulder 16. Extending downwardly from the member 14 is a second or lower member 18 having a shape resembling that of a truncated, right rectangular pyramid. The member 18 terminates at a bottom 20. Extending from the bottom 18 is a drain valve 22. The housing 12 is supported by a plurality of supports or legs **24*a–d*, a top support 26 and a plurality of lateral supports 28 which engage the shoulder 16. The support 26 also serves to rigidify the housing 12, especially if a plastic housing is used. It should be noted that the front lateral support has been removed for clarity. Fitted to the top support 26 is a hinged cover 32 received within a ledge or shoulder 27 of the housing 12. A small amount of water, generally shown as 34, may optionally be placed within the lower portion of the member 18. Above the water is located a larger volume of cleaning agent such as paint solvent 36. Solvent and water, if used, are poured into the housing through its open end 38. The water 34 having a higher specific gravity than the paint solvent 36 will tend to the bottom of the member 18 where it and any dislodged paint can be periodically removed by opening the drain valve. Upon removal of the dislodged paint additional water and/or solvent may then added to the solvent 36. Secured to the support 24*d* is a pump 40. While an air actuated, pulsating pump is shown it is not a requirement of the invention. The pump 40 includes an inlet 42 in communication with a filter 45 disposed in the solvent 36 and an outlet 44 situated above the solvent 36. The outlet 44 is connected to a manifold assembly 52, as more clearly shown in FIG. 2. The pump 40 further includes an air inlet 46** adapted to receive pressurized air from a compressor or the like.

Figure 2:
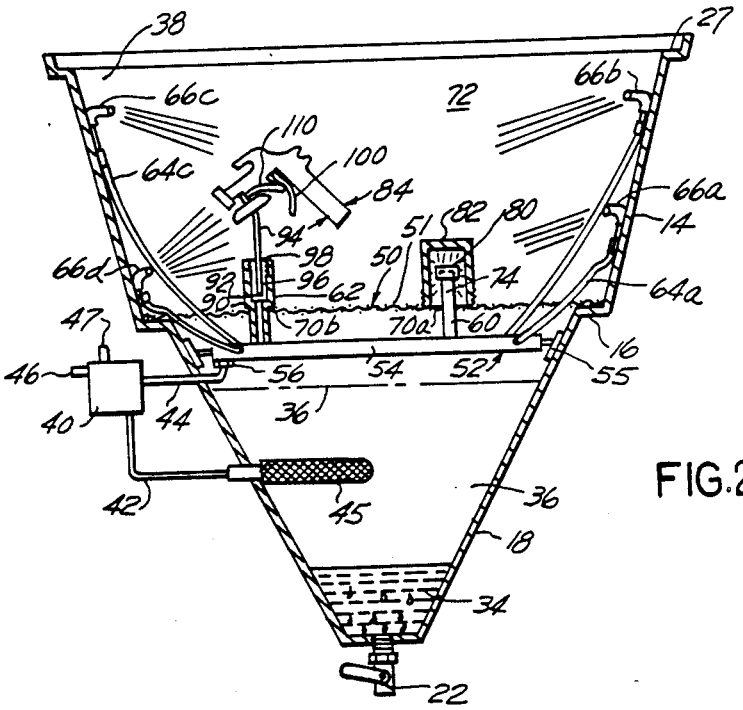

Reference is now made to FIG. 2 which is a cross-sectional view of the housing and illustrates many of the major features of the present invention. FIG. 2 is an isolated view of the housing 12 and does not illustrate the support means or cover 32 shown is FIG. 1. Situated above the solvent 36 and supported upon the shoulder 16 is an optional wire mesh 50 or other suitable foraminous material. The mesh 50 divides the housing 12 into a work chamber 72, separate from the solvent 36 and water 34, into which parts to be cleaned may be placed and also defines a surface 51 for supporting such parts. Positioned below the mesh 50 is the manifold assembly 52, comprising a manifold 54, secured to the housing 12 by brackets 55 or other equivalent mounting means. The manifold assembly 52 further includes an inlet 56 adapted to communicate with the output 44 of the pump 40 and a plurality of outlets 60, 62 and 64 *a–d* also shown in FIG. 1. These outlets extend through openings 70 is the mesh 50 and into the working chamber 72 of the housing 12. More specifically, the manifold assembly outlets includes a first outlet 60 comprising a first tube 74 which extends through one of the openings 70*a*. Situated atop the tube 74 is a first spray head 80. A cup 82 of a spray gun 84 may be positioned on the mesh 50 in an inverted manner about the spray head 80 to receive of the solvent 36. Another manifold outlet such as outlet 62 comprising another tube 90 which includes a stepped bore 92 adapted to receive and support the spray gun 84. The spray gun 84 illustrated in FIG. 2 is of the syphon type and its inlet comprises a syphon tube 94 which is received and supported within the stepped bore 90.

Returning to FIGS. 1 and 2, as previously mentioned the manifold assembly 52 further includes additional outlets 64*a–d*. These additional outlets may comprise tubing extending from the manifold 54 into the work chamber 72. These outlets 64 extend from the manifold 54 and are located proximate the inner corners of the upper member 14. Fitted to each of these outlets 64 is a spray nozzle 66 which is oriented to spray solvent upon the exposed portions of an object, such as the gun 84 and a cup, such as cup 82, lid, etc., thereby providing a source of solvent to clean the exposed surfaces of these parts.

FIG. 3 illustrates another means for cleaning paint residue from paint cups and cans comprising a tube 302 adapted to be inserted into the manifold 54 in a manifold outlet such a 60. The lower end of the pipe 302 is threaded at 304 for insertion into the manifold. A substantially hollow member 306 is threadably attached to the pipe 302. Extending from the hollow member 306 are a plurality of spray nozzle 310*a–c* which are oriented at fixed angles relative to the axis of the hollow member 306. The purpose of the angled orientation of the nozzles is discussed below. Supported above the member 306 is a cup or can support mechanism 320. The support 320 includes a central member 322 having a passage 324. Extending radially outward and upward from the central member are a plurality of ribs 326 support an inverted cup or can 330 shown in phantom lines. In the above embodiment the ends 328 of the ribs engage the can, This type of engage is by no means a limitation of the invention. A alternate embodiment of the invention is illustrated in FIG. 7. The embodiment of FIGS. 3 and 4 includes three ribs 326*a–c*, however this also is not a limitation of the invention. As illustrated the ends 328*a–c* of the ribs 326 may terminate in a plane such that the bottom of the can may be supported in a generally horizontal orientation. It should be appreciated that if the length of one of the ribs is made shorter than the remaining ribs the can will be oriented at an angle which may be beneficial. The ribs 326 may be sized such that the respective ends 328 engage the corner 332 of the can 330. As mentioned above, the central member 324 includes a passage 322. Extending through the passage 324 is stub member 334. The stub member may be fabricated as an extension of the member 306 or as a separate member appropriately attached. It should be noted that the member 306 need not include a passage extending through its entire length, a partial bore is sufficient to communicate solvent to the various nozzles. The central member 322 is axially secured to the stub member 334 by a fastener 336. The central member 322 is sized relative to the stub member 334 so that it is free to rotate. As can be seen the central member 322 and stub member 334 cooperate to form a bushing therebetween. An additional bearing or bushing may be provided to reduce the friction at the sliding interface between the central member and stub member.

In operation pressurized cleaning solvent is forced through the pipe 302 into the member 306 and through the nozzles 310*a–c*. The nozzles are oriented at various angles relative to the member 306 and to the can 330 to be cleaned such that the spray emanating from the nozzles 310 impacts the interior of the can at an angle to produce a tangential component, T, (see FIG. 4) of spray to rotate the can 330 and can support 320 about the stub member 334. In addition, the nozzles are oriented to clean various sections of the can. As an example, nozzle 310*a* may be directed downwardly toward the open end 340 of the can and toward nearby wall 342 portions. Nozzle 310*b* may be orientated upwardly to clean the bottom 344 of the can and in particular the corner 322. Nozzle 310*c* may be directed outwardly in a generally radial direction to clean the walls 346 of the can 330. The exterior surfaces of the can 330 will be cleaned by the solvent emanating from the nozzles 66 positioned about the interior of the housing. The spray from the nozzle may be oriented in a manner to cause the object ot rotate.

Reference is made to FIGS. 5 and 6 which illustrate a device 360 for cleaning an object such as the lid 350. This lid may be a conventional type lid of paint can, as illustrated, or a mixing lid known to those fimilar with painting processes. While a substantially flat lid is illustated in FIG. 5 it should be appreciated that the present invention is usable with a wide variety of different shaped objects. The lid 350 is showm is phantom line in FIG. 5. The lid cleaning device 360 includes a substantilly hollow member 362, similar to the member 306 of FIG. 3. The member 362 is appropriately secured to the manifold 54. A nozzle 364 extends, in fluid communication, from the member 362. Rotatably supported above the member 362 is a lid support mechanism 370. The lid support 370 includes a central member 372 having a passage 374 and a plurality of ribs 380 extending radially and upwardly therefrom. The central member is rotationally supported relative to the member 362 by a stub member 376 similar to that discribed in FIG. 3. Attached to two of the ends 382*a* and *b* of the ribs 380 are fasteners or stops 384*a* and *b*. Attached to the end of the remaining rib i.e. rib 380*c* is a spring loaded fastener generally shown as 386. The spring loaded fastener includes a washer-like fastener 388 biased radially inwardwardly or outwardly by a spring 390. As an example, if an outwardly biased spring is desired the spring could be mounted between the central member and the sliding fastener 388. One end of the spring may be attached to the fastener 388 with the other end of the spring fixed to the rib or to the central member. To mount a lid upon the support, the fastener 388 is moved inwardly to compress the spring. In this position the spring will generate a bias force directed outwardly. In the illustrated embodiment one end of the spring 390 is secured by a retainer such as a spring clip 392.

Prior to receipt of the lid 350 the fastener 388 is baised inwardly by the spring 390. To secure the lid 350 upon the lid support 370 the operator pushes an edge of the lid against the fastener 388 urging it outwardly a sufficient amount to permit the opposing edges of the lid to be fitted against the fasteners 382*a* and *b*. In the clamped position the spring 390 secures the lid to the support 370.

In operation, pressurized solvent is forced through the manifold 54, member 362 and out through the nozzle 364. As illustrated, the nozzle generates a spray substantilly radially outward having a tangential component sufficient to react against the lower surface of the lid 350 to cause the lid and the lid support 370 to rotate relative to the spray. The top surface of the lid will be cleaned by the solvent emanating from the spray nozzles 66 positioned about the interior of the housing. The spray nozzles 66, schematically illustrated in FIGS. 5 and 6, may be oriented so that the spray tangentially impacts the lid causing or helping it to rotate.

FIG. 7 illustrates still another embodiment of a can support 400. The support includes a rotatable central member 402 similar to those previously described. Extending from the central member are a plurality of ribs 404 which are spider or umbrella or fountain shaped. The ribs 404 are preferrably resilient so that they may be compressed radially, tangentially and/or axially. To place a can upon the ribs 404 the operator would fit the can about the top of the ribs and push the can downwardly radially compressing the ribs. After the can is in place, the ribs 404 will be naturally biased outwardly securing the can in place. Further, if the can diameter is substantially smaller that the normal diameter across the ribs and the ribs are complient in a tangential direction, the operator may twist the ribs clockwise or counterclockwise reducing the diameter (across the ribs) to permit entry within the small can.

Many changes and modifications in the above described embodiment of the invention can, of course, be carried out without departing from the scope thereof. Accordingly, that scope is intended to be limited only by the scope of the appended claims.

We claim:

1. A paint removal system for cleaning paint from objects such as a paint can and its lid comprising:
- a housing defining a work chamber;
- a manifold adapted to receive pressurized cleaning solvent;
- means for supporting the object to be cleaned within the work chamber including:
  - first conduit means in fluid communication with a first outlet of the manifold;
  - at least one spray nozzle for spraying cleaning solvent on the lid;
  - first bracket means for securing the lid, and rotatable about an axis including a central member and a plurality of outwardly extending ribs;
  - means fitted to the ribs for engaging the peripheral outer edge of the object including bias means, supported completely on one of the ribs including means, movable in a first direction for resiliently engaging the peripheral edge of the lid and for biasing the lid into the engaging means associated with the other ribs.

2. The system as defined in claim 1 wherein the biasing means includes a spring fastener comprising a fastener slidable relative to the one rib and a spring, positioned outward of the sliding fastener, for biasing same inwardly.

3. The system as defined in claim 1 wherein the spray nozzle generates a spray pattern directed at a surface of the lid and wherein the spray pattern includes a tangential component sufficient to rotate the lid and first bracket means.

4. The system as defined in claim 3 wherein the manifold includes other outlets adapted to receive other spray nozzles situated about the housing for spraying solvent upon other surfaces of the lid and for causing the lid to rotate about the axis, and upon the various surfaces of the paint can.

5. The system as defined in claim 4 wherein the central member in cooperation with the first conduit means, forms a sliding rotary interface about which the first bracket means and lid may rotate.

6. The system as defined in claim 1 wherein the supporting means includes:
- second conduit means extending from and in fluid communication with the manifold;
  - a plurality of spray nozzles oriented at angles relative to an axis of the second conduit means and in fluid communications therewith;
  - second bracket means, rotatable relative to the second conduit means including a central member and a plurality of outwardly extending ribs for engaging the interior of the paint can.

7. The system as defined in claim 6 wherein at least two of the ribs are of equal length and include end portions adapted to engage the bottom interior of the paint can.

8. The system as defined in claim 7 wherein the second bracket means includes at least three ribs wherein one of the ribs is shorter than the other ribs so as to support the paint can at an angle relative to the second conduit means.

9. A paint removal system for cleaning paint from a paint can lid comprising:
- a housing defining a work chamber;
- a manifold adapted to receive pressurized cleaning solvent;
- means for supporting the object to be cleaned within the work chamber including:
  - first conduit means in fluid communication with a first outlet of the manifold;
  - at least one spray nozzle for spraying cleaning solvent on the lid;
  - first bracket means for securing the lid, and rotatable about an axis including a central member and a plurality of outwardly extending ribs;
  - means fitted to the ribs for engaging the peripheral outer edge of the object including bias means, supported completely on one of the ribs including means, movable in a first direction for resiliently engaging the peripheral edge of the lid and for biasing the lid into the engaging means (384) associated with the other ribs.

10. The system as defined in claim 9 further including bias means, supported on one of the ribs including means, movable in a first direction for resiliently engaging the peripheral edge of the lid and for biasing the lid into the engaging means (384) associated with the other ribs.

* * * * *